US007523791B2

(12) United States Patent
Aoki

(10) Patent No.: US 7,523,791 B2
(45) Date of Patent: Apr. 28, 2009

(54) IMPACT POWER TOOL

(75) Inventor: Yonosuke Aoki, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/698,926

(22) Filed: Jan. 29, 2007

(65) Prior Publication Data

US 2007/0175647 A1 Aug. 2, 2007

(30) Foreign Application Priority Data

Feb. 1, 2006 (JP) ..... 2006-025136

(51) Int. Cl.
*B25D 11/00* (2006.01)
*B25D 17/24* (2006.01)

(52) U.S. Cl. ..... 173/210; 173/206; 173/162.1

(58) Field of Classification Search ..... 173/48, 173/91, 137, 162.1, 206, 210, 211, 201
See application file for complete search history.

(56) References Cited

U.S. PATENT DOCUMENTS

| | | | | |
|---|---|---|---|---|
| 3,921,729 | A * | 11/1975 | Schmuck | 173/14 |
| 4,284,148 | A | 8/1981 | Wanner et al. | |
| 4,763,733 | A * | 8/1988 | Neumaier | 173/48 |
| 5,678,641 | A * | 10/1997 | Manschitz et al. | 173/114 |
| 5,842,527 | A * | 12/1998 | Arakawa et al. | 173/48 |
| 6,478,095 | B2 * | 11/2002 | Neumaier | 173/48 |
| 6,557,648 | B2 * | 5/2003 | Ichijyou et al. | 173/48 |
| 6,675,908 | B1 * | 1/2004 | Frauhammer et al. | 173/48 |
| 6,810,969 | B2 * | 11/2004 | Meixner | 173/201 |
| 6,907,943 | B2 * | 6/2005 | Ikuta | 173/117 |
| 6,938,705 | B2 * | 9/2005 | Kikuchi | 173/201 |
| 7,204,322 | B2 * | 4/2007 | Sakai | 173/162.1 |
| 7,303,026 | B2 * | 12/2007 | Frauhammer et al. | 173/48 |

FOREIGN PATENT DOCUMENTS

| | | | |
|---|---|---|---|
| EP | 0 280 195 | A2 | 8/1988 |
| EP | 0 680 807 | A1 | 11/1995 |
| EP | 1 464 449 | A2 | 10/2004 |
| GB | 2 154 497 | A | 9/1985 |
| JP | A 8-318342 | | 12/1996 |
| WO | WO 01/05558 | A1 | 1/2001 |

* cited by examiner

*Primary Examiner*—Paul R Durand
(74) *Attorney, Agent, or Firm*—Oliff & Berridge, PLC

(57) ABSTRACT

An object of the invention is to provide an improved technique for lessening an impact force caused by rebound of a tool bit after its striking movement in an impact power tool. The representative impact power tool comprises a tool body, a hammer actuating member, a tool holder, a driving mechanism, a weight placed in contact with the hammer actuating member to move rearward by a reaction force transmitted from the hammer actuating member when the hammer actuating member performs a hammering operation on the workpiece and an elastic element elastically deformed when the weight moves rearward in the tool body to push the elastic element such that the elastic element absorbs the reaction force transmitted to the weight. The weight is defined one or both of the cylinder and the tool holder.

8 Claims, 12 Drawing Sheets

IMPACT POWER TOOL

BACKGROUND OF THE INVENTION

1. Field of the Invention

The present invention relates to an impact power tool for performing a linear hammering operation on a workpiece, and more particularly to a technique for cushioning a reaction force received from the workpiece during hammering operation.

2. Description of the Related Art

Japanese non-examined laid-open Patent Publication No. 8-318342 discloses a technique for cushioning an impact force caused by rebound of a tool bit after its striking movement in a hammer drill. In the known hammer drill, a rubber ring is disposed between the axial end surface of a cylinder and an impact bolt. The rubber ring has a function of cushioning the impact force caused by rebound of the tool bit and positioning the hammer drill during a hammering operation. It is advantageous to make the rubber ring soft in order to absorb the rebound of the tool bit. On the contrary, it is advantageous to make the rubber ring hard in order to improve the positioning accuracy. Thus, while two different properties are required to the known rubber ring, it is difficult to provide the rubber ring with a hardness that satisfies the both functional requirements. In this point, further improvement is required.

SUMMARY OF THE INVENTION

Accordingly, it is an object of the invention to provide an improved technique for lessening an impact force caused by rebound of a tool bit after its striking movement in an impact power tool.

The above-described problem can be solved by the features of the claimed invention. The representative impact power tool according to the invention includes a tool body, a hammer actuating member disposed in a tip end region of the tool body to perform a predetermined hammering operation on a workpiece by reciprocating movement in its axial direction, a tool holder that houses the hammer actuating member for axial movement, a driving mechanism that linearly drives the hammer actuating member, and a cylinder that houses the driving mechanism.

The "predetermined hammering operation" in this invention includes not only a hammering operation in which the hammer actuating member performs only a linear striking movement in the axial direction, but a hammer drill operation in which it performs a linear striking movement and a rotation in the circumferential direction. The "hammer actuating member" according to the invention may preferably and typically be defined by a tool bit, or by a tool bit and an impact bolt that transmits a striking force in contact with the tool bit. Further, the "driving mechanism" according to the invention typically comprises a driving element in the form of a piston which reciprocates within the cylinder, and a striking element in the form of a striker which reciprocates by pressure fluctuations caused by the reciprocating movement of the piston within the air chamber and strikes the impact bolt.

The representative impact power tool includes a weight and an elastic element. When the hammer actuating member performs a hammering operation on the workpiece, the cushioning weight is placed in contact with the hammer actuating member and can be caused to move rearward in the tool body by a reaction force transmitted from the hammer actuating member. The elastic element is elastically deformed when the weight is caused to move rearward in the tool body and pushes the elastic element, whereby the elastic element absorbs the reaction force transmitted to the weight. Further, the weight comprises either the cylinder or the tool holder. The "elastic element" typically comprises a spring, but it may comprise a rubber.

During hammering operation, the hammer actuating member is caused to rebound by receiving the reaction force of the workpiece after striking movement. According to the invention, with the construction in which the reaction force is transmitted from the hammer actuating member to the weight in the position in which the weight is placed in contact with the hammer actuating member, the reaction force is nearly 100% transmitted. In other words, the reaction force is transmitted by exchange of momentum between the hammer actuating member and the weight. By this transmission of the reaction force, the weight is caused to move rearward in the direction of action of the reaction force. The rearward moving weight elastically deforms the elastic element, and the reaction force of the weight is absorbed by such elastic deformation. Specifically, according to this invention, the impact force (reaction force) caused by rebound of the hammer actuating member can be absorbed by the rearward movement of the weight and by the elastic deformation of the elastic element which is caused by the movement of the weight. As a result, vibration of the impact power tool can be reduced.

According to this invention, either the cylinder or the tool holder as an existing part forming the main part of the impact power tool may be utilized to define the cushioning weight. Therefore, the weight can be easily secured without increasing the mass of the impact power tool. Further, with the construction in which the existing part is utilized, compared with the case, for example, in which a cushioning weight is provided as an additional member, the structure can be simpler, and the assembling operation is not complicated.

As another aspect of the invention, the weight may preferably be placed in contact with the hammer actuating member via an intervening member made of metal and is caused to move rearward in the tool body by receiving a reaction force from the hammer actuating member via the intervening member. The "intervening member made of metal" typically comprises a ring-like metal washer or a metal cylindrical element, and it also suitably includes a metal intervening member divided in the circumferential direction, or a plurality of metal intervening members disposed in series in the axial direction of the hammer bit. With the construction in which the cushioning weight contacts the hammer actuating member via the metal intervening member, for example, by adjusting the length of the intervening member in the axial direction of the hammer bit, the reaction force of the hammer actuating member can be transmitted to the weight while the cylinder or the tool holder which forms the weight is held in the existing position of placement in the axial direction of the hammer bit.

Further, as another aspect of the invention, when the weight comprises the cylinder, the cylinder may preferably include a rear cylinder element that comprises a rear portion of the cylinder and forms the weight and a front cylinder element that comprises a front portion of the cylinder. The rear cylinder element is separated from the front cylinder element and placed in contact with the hammer actuating member via the front cylinder element or via the metal intervening member and the front cylinder element in series. Further, the rear cylinder element is caused to move rearward in the tool body by a reaction force transmitted from the hammer actuating member via the front cylinder element or via the metal intervening member and the front cylinder element. Thus, the rear cylinder element can be utilized as a weight for cushioning a reaction force while housing the piston and the striker which form the driving mechanism. The front cylinder element can be utilized as a reaction force transmitting member that transmits the reaction force of the hammer actuating member to the rear cylinder element.

As another aspect of the invention, while the weight comprises the tool holder, the tool holder may preferably include a rear tool holder element that comprises a rear portion of the tool holder and forms the weight and a front tool holder element that comprises a front portion of the tool holder. The rear tool holder element is separated from the front tool holder element and placed in contact with the hammer actuating member. Further, the rear tool holder element is caused to move rearward in the tool body by a reaction force transmitted from the hammer actuating member. Thus, the front tool holder element can be provided with a function of holding the hammer actuating member, and the rear tool holder element can be utilized as a cushioning weight.

As another aspect of the invention, the hammer actuating member may preferably include an impact bolt that is linearly driven in the axial direction by the driving mechanism, and a tool bit that is caused to reciprocate by receiving a striking force from the impact bolt and thereby performs a hammering operation on the workpiece. Further, during hammering operation on the workpiece, the impact bolt transmits the reaction force from the workpiece to the weight by contact with the weight. Thus, the efficiency of transmission of the reaction force to the weight increases, so that the impact absorbing function can be enhanced.

As another aspect of the invention, the hammer actuating member may preferably include an impact bolt that is linearly driven in the axial direction by the driving mechanism, and a tool bit that is caused to reciprocate by receiving a striking force from the impact bolt and thereby performs a hammering operation on the workpiece. Further, the tool holder rotates on the axis of the hammer actuating member to thereby cause the tool bit to rotate, so that the tool bit performs a hammer drill operation by linear striking movement via the driving mechanism and the impact bolt and by rotation via the tool holder. The "tool holder" may preferably and typically include a bit holding part and an extension that extends rearward from the bit holding part in the axial direction and functions as a power transmitting part that receives a rotation driving force. Thus, the impact power tool can be provided in which the hammer actuating member can perform rotation on its axis in addition to the linear striking movement.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact power tools and method for using such impact power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIRST EMBODIMENT

Figure 1:
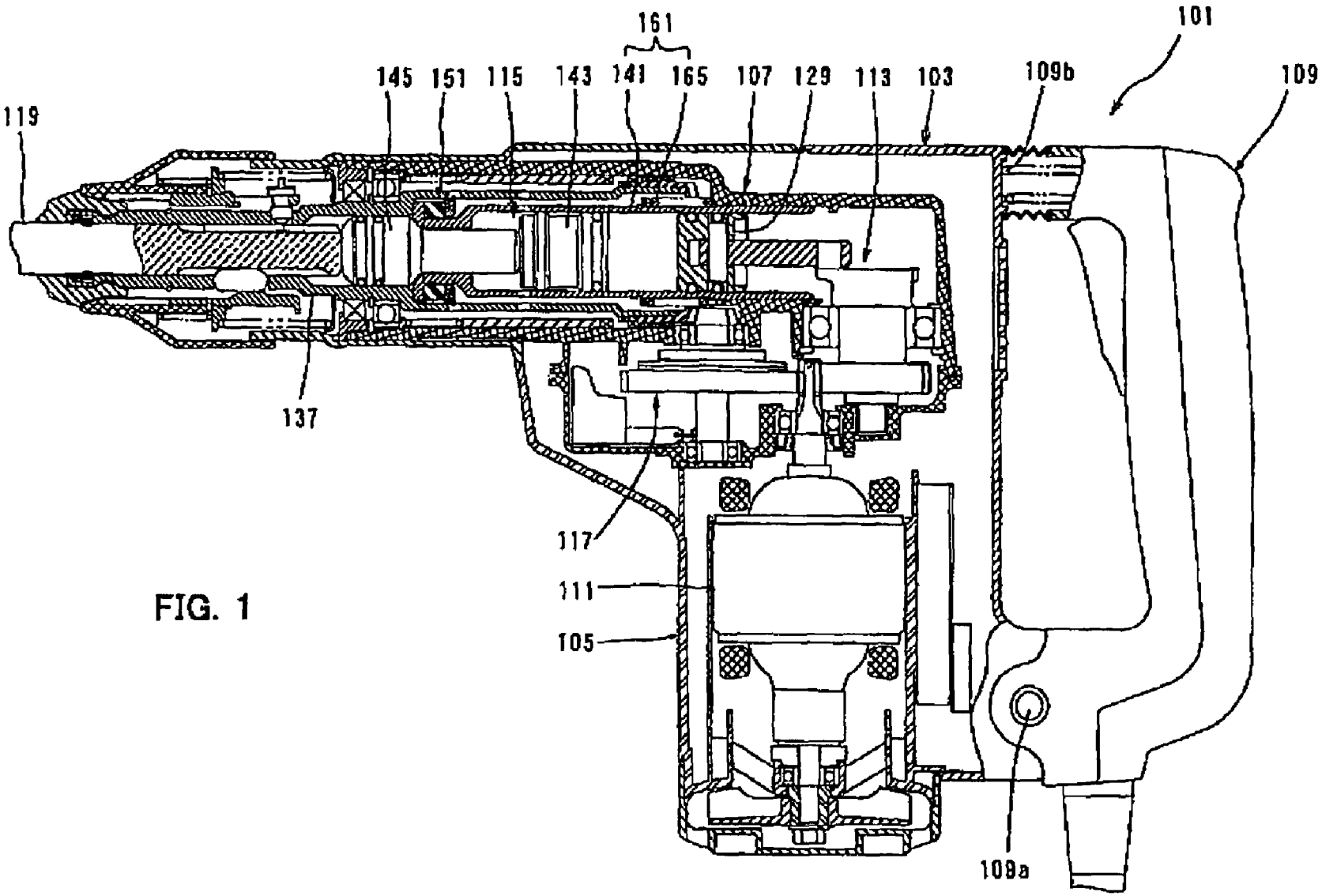
FIG. 1 is a sectional side view schematically showing an entire electric hammer drill according to a first embodiment of the invention under loaded conditions in which a hammer bit is pressed against a workpiece.

A first embodiment of the present invention will now be described with reference to FIGS. 1 to 3. FIG. 1 is a sectional side view showing an entire electric hammer drill 101 as a representative embodiment of the impact power tool according to the present invention, under loaded conditions in which a hammer bit is pressed against a workpiece. As shown in FIG. 1, the hammer drill 101 includes a body 103, a hammer bit 119 detachably coupled to the tip end region (on the left side as viewed in FIG. 1) of the body 103 via a tool holder 137, and a handgrip 109 that is held by a user and connected to the rear end region of the body 103 on the side opposite the hammer bit 119. The body 103 is a feature that corresponds to the "tool body" according to the present invention. The hammer bit 119 is held by the hollow tool holder 137 such that it is allowed to reciprocate with respect to the tool holder 137 in its axial direction and prevented from rotating with respect to the tool holder 137 in its circumferential direction. The hammer bit 119 is a feature that corresponds to the "tool bit" according to the invention. According to the embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a motion converting mechanism 113, a power transmitting mechanism 117 and a striking mechanism 115. The motion converting mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in the circumferential direction. The handgrip 109 is generally U-shaped in side view, having a lower end and an upper end. The lower end of the handgrip 109 is rotatably connected to the rear end lower portion of the motor housing 105 via a pivot 109*a*, and the upper end is connected to the rear end upper portion of the motor housing 105 via an elastic spring 109*b* for absorbing vibration. Thus, the transmission of vibration from the body 103 to the handgrip 109 is reduced.

Figure 2:
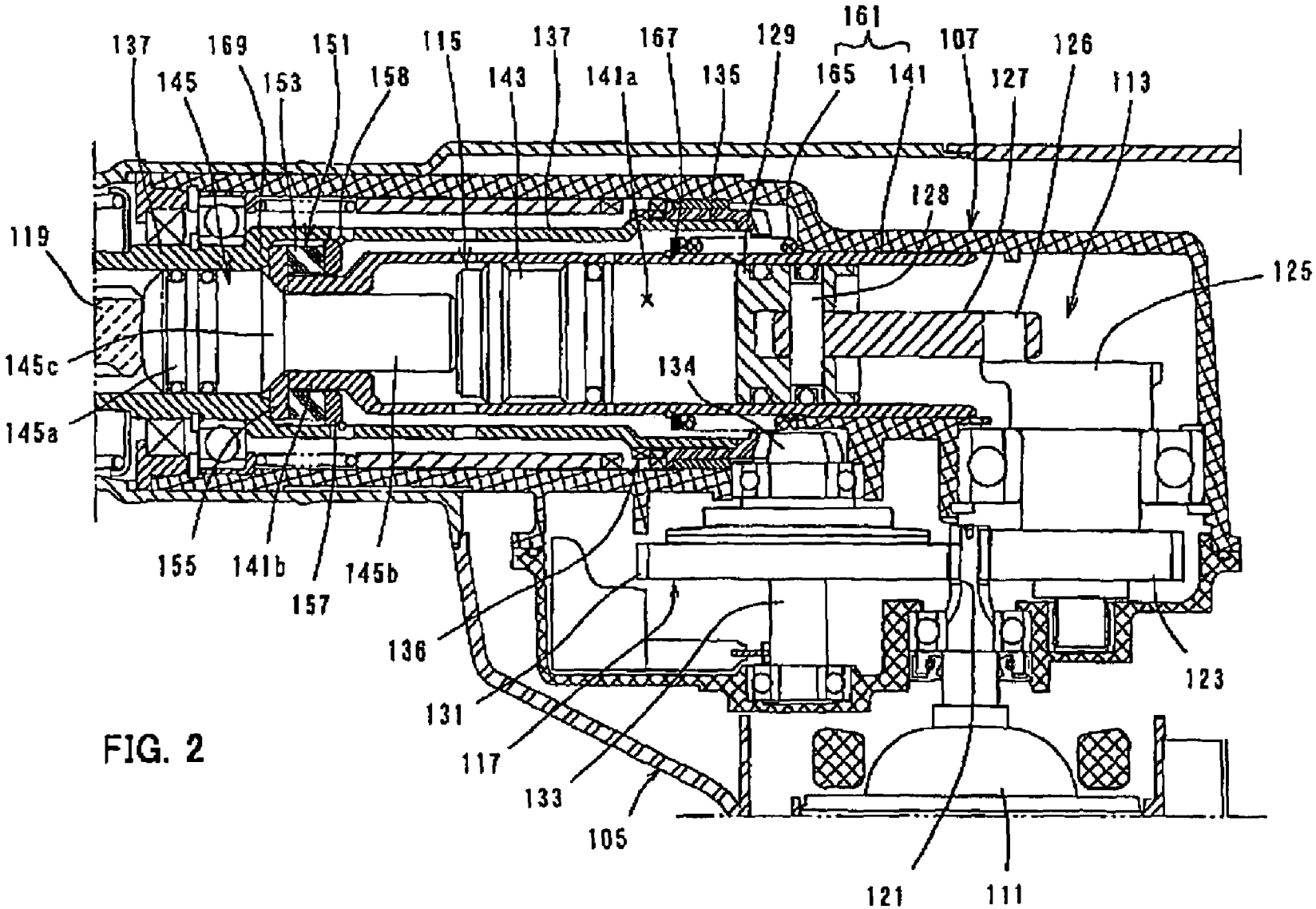
FIG. 2 is an enlarged sectional view showing an essential part of the hammer drill.

FIG. 2 is an enlarged sectional view showing an essential part of the hammer drill 101. The motion converting mechanism 113 includes a driving gear 121 that is rotated in a horizontal plane by the driving motor 111, a driven gear 123 that engages with the driving gear 121, a crank plate 125 that rotates together with the driven gear 123 in a horizontal plane, a crank arm 127 that is loosely connected at one end to the crank plate 125 via an eccentric shaft 126 in a position displaced a predetermined distance from the center of rotation of the crank plate 125, and a driving element in the form of a piston 129 mounted to the other end of the crank arm 127 via a connecting shaft 128. The crank plate 125, the crank arm 127 and the piston 129 form a crank mechanism.

The power transmitting mechanism 117 includes a driving gear 121 that is driven by the driving motor 111, a transmission gear 131 that engages with the driving gear 121, a transmission shaft 133 that is caused to rotate in a horizontal plane together with the transmission gear 131, a small bevel gear 134 mounted onto the transmission shaft 133, a large bevel gear 135 that engages with the small bevel gear 134, and the tool holder 137 that is caused to rotate together with the large bevel gear 135 in a vertical plane. The tool holder 137 includes a bit holding part for holding the hammer bit 119 and an extension that extends rearward from the bit holding part in the axial direction. The extension is connected to the large bevel gear 135 via an engagement clutch 136. Thus, the extension of the tool holder 137 serves as a power transmitting part that receives a rotation driving force from the large bevel gear 135.

The striking mechanism 115 includes a striker 143 that is slidably disposed together with the piston 129 within the bore of a cylinder 141. The striker 143 is driven via the action of an air spring of an air chamber 141*a* of the cylinder 141 which is caused by sliding movement of the piston 129. The striker 143 then collides with (strikes) an intermediate element in the form of an impact bolt 145 that is slidably disposed within the tool holder 137 and transmits the striking force to the hammer bit 119 via the impact bolt 145. The impact bolt 145 includes a large-diameter portion 145*a*, a small-diameter portion 145*b* and a tapered portion 145*c*. The large-diameter portion 145*a* is fitted in close contact with the inner surface of the tool holder 137, while a predetermined extent of space is defined between the small-diameter portion 145*b* and the inner peripheral surface of the tool holder 137. The tapered portion 145*c* is formed in the boundary region between the both diameter portions 145*a* and 145*b*. The impact bolt 145 is disposed within the tool holder 137 in such an orientation that the large-diameter portion 145*a* is on the front side and the small-diameter portion 145*b* is on the rear side.

The hammer drill 101 includes a positioning member 151 that positions the body 103 with respect to the workpiece by contact with the impact bolt 145 when the impact bolt 145 is pushed rearward (toward the piston 129) together with the hammer bit 119 under loaded conditions in which the hammer bit 119 is pressed against the workpiece by the user applying a pressing force forward to the body 103 while holding the handgrip 109. The positioning member 151 is a unit part including a ring-like elastic member in the form of a rubber ring 153, a front-side hard metal washer 155 joined to the axially front surface of the rubber ring 153, and a rear-side hard metal washer 157 joined to the axially rear surface of the rubber ring 153. The positioning member 151 is loosely fitted onto the small-diameter portion 145*b* of the impact bolt 145. The rubber ring 153 and the rear metal washer 157 are disposed with a predetermined clearance from the small-diameter portion 145*b*.

When the hammer bit 119 is pressed against the workpiece and the impact bolt 145 is pushed rearward, the tapered portion 145*c* of the impact bolt 145 contacts the front metal washer 155 and the rear metal washer 157 contacts the tool holder 137 via a retaining ring 158. The tool holder 137 is mounted to the gear housing 107 such that it is prevented from relative movement in the axial direction and allowed to rotate on its axis. Thus, the rubber ring 153 of the positioning member 151 elastically connects the impact bolt 145 to the tool holder 137. The front metal washer 155 has a tapered bore, and when the impact bolt 145 is pushed rearward, the tapered surface of the front metal washer 155 comes in surface contact with the tapered portion 145*c* of the impact bolt 145.

The hammer drill 101 according to the embodiment includes an impact damper 161 for cushioning the impact force defined by a reaction force that is caused by rebound of the hammer bit 119 after the striking movement of the hammer bit 119 during hammering operation on the workpiece. The impact damper 161 includes the cylinder 141 that is made of hard metal and contacts the impact bolt 145 via the front metal washer 155 and a compression coil spring 165 that normally biases the cylinder 141 forward toward the impact bolt 145. According to the embodiment, the cylinder 141 is utilized as a weight of the impact damper 161, while the cylinder 141 is an existing part forming the main part of the hammer drill 101. The cylinder 141, the compression coil spring 165 and the front metal washer 155 are features that correspond to the "weight", the "elastic element" and the "intervening member", respectively, according to the invention.

The cylinder 141 is mounted to the gear housing 107 such that it is allowed to move with respect to the gear housing 107 in the axial direction of the cylinder 141 (in the axial direction of the hammer bit 119). The cylinder 141 has a front portion having a smaller diameter or a front small-diameter cylindrical portion 141*b*. The front small-diameter cylindrical portion 141*b* of the cylinder 141 extends forward through the clearance between the inner surfaces of the rubber ring 153 and rear-side metal washer 157 of the positioning member 151 and the outer surface of the small-diameter portion 145*b* of the impact bolt 145. The front end surface of the front small-diameter cylindrical portion 141*b* comes in surface contact with a radially inward portion of the rear surface of the front metal washer 155 of the positioning member 151. The compression coil spring 165 is disposed on the cylinder 141. One axial end of the compression coil spring 165 is held in contact with a spring receiving ring 167 fixed to the cylinder 141 and the other axial end is in contact with the gear housing 107. Specifically, the compression coil spring 165 is elastically disposed between the cylinder 141 and the gear housing 107 under a predetermined initial load so that the cylinder 141 is normally biased forward. The forward position of the cylinder 141 biased forward by the compression coil spring 165 is defined by contact of the front metal washer 155 of the positioning member 151 with a stepped position-control stopper 169 formed in the tool holder 137.

As shown in FIGS. 1 and 2, under loaded conditions in which the impact bolt 145 is pushed rearward together with the hammer bit 119, the cylinder 141 is in contact with the impact bolt 145 via the front metal washer 155. Therefore, when the hammer bit 119 and the impact bolt 145 are caused to rebound by receiving a reaction force from the workpiece after striking movement, the reaction force from the impact bolt 145 is transmitted to the cylinder 141 which is held in contact with the impact bolt 145 via the front metal washer 155. Thus, the front metal washer 155 forms a reaction force transmitting member. When the cylinder 141 is moved rearward by receiving a reaction force from the impact bolt 145, the compression coil spring 165 is pushed by the cylinder 141. As a result, the compression coil spring 165 elastically deforms and absorbs the reaction force.

Figure 3:
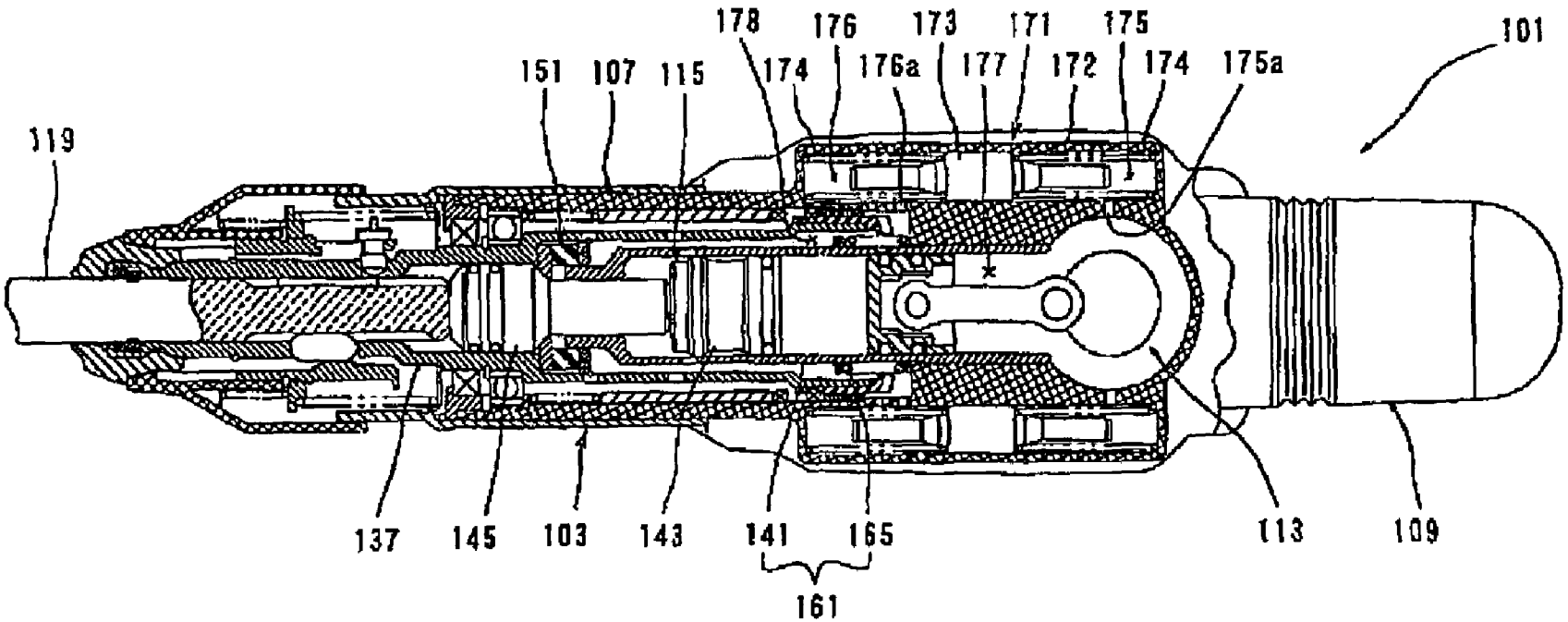
FIG. 3 is a sectional plan view showing the entire hammer drill.

Further, as shown in FIG. 3 showing the hammer drill 101 in sectional plan view, the hammer drill 101 includes a pair of dynamic vibration reducers 171. The dynamic vibration reducers 171 are arranged on the both sides of the axis of the hammer bit 119 and have the same construction. Each of the dynamic vibration reducers 171 mainly includes a cylindrical body 172 that is disposed adjacent to the body 103, a vibration reducing weight 173 that is disposed within the cylindrical body 172, and biasing springs 174 that are disposed on the right and left sides of the weight 173. The biasing springs 174 exert a spring force on the weight 173 in a direction toward each other when the weight 173 moves in the axial direction of the cylindrical body 172 (in the axial direction of the hammer bit 119). The dynamic vibration reducer 171 having the above-described construction serves to reduce impulsive and cyclic vibration caused when the hammer bit 119 is driven. Specifically, the weight 173 and the biasing springs 174 serve as vibration reducing elements in the dynamic vibration reducer 171 and cooperate to passively reduce vibration of the body 103 of the hammer drill 101 on which a predetermined outside force (vibration) is exerted. Thus, the vibration of the hammer drill 101 of this embodiment can be effectively alleviated or reduced.

Further, in the dynamic vibration reducer 171, a first actuation chamber 175 and a second actuation chamber 176 are defined on the both sides of the weight 173 within the cylindrical body 172. The first actuation chamber 175 communicates with the crank chamber 177 via a first communicating portion 175*a*. The crank chamber 177 is normally hermetic and prevented from communication with the outside. The second actuation chamber 176 communicates with a cylinder accommodating space 178 of the gear housing 107 via a second communicating portion 176*a*. The pressure within the crank chamber 177 fluctuates when the motion converting mechanism 113 is driven. Such pressure fluctuations are caused when the piston 129 forming the motion converting mechanism 113 linearly moves within the cylinder 141. The fluctuating pressure caused within the crank chamber 177 is introduced from the first communicating portion 175*a* to the first actuation chamber 175, and the weight 173 of the dynamic vibration reducer 171 is actively driven. In this manner, the dynamic vibration reducer 171 performs a vibration reducing function. Specifically, in addition to the above-described passive vibration reducing function, the dynamic vibration reducer 171 functions as an active vibration reducing mechanism for reducing vibration by forced vibration in which the weight 173 is actively driven. Thus, the vibration which is caused in the body 103 during hammering operation can be further effectively reduced or alleviated.

Operation of the hammer drill 101 constructed as described above will now be explained. When the driving motor 111 (shown in FIG. 1) is driven, the rotating output of the driving motor 111 causes the driving gear 121 to rotate in the horizontal plane. When the driving gear 121 rotate, the crank plate 125 revolves in the horizontal plane via the driven gear 123 that engages with the driving gear 121. Then, the piston 129 slidingly reciprocates within the cylinder 141 via the crank arm 127. The striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on a workpiece.

The rotating output of the driving motor 111 is transmitted from the transmission gear 131 that engages with the driving gear 121 to the small bevel gear 134 via the transmission shaft 133. Thus, the small bevel gear 134 rotates in a horizontal plane. The large bevel gear 135 that engages with the small bevel gear 134 is then caused to rotate in a vertical plane, which in turn causes the tool holder 137 and the hammer bit 119 held by the tool holder 137 to rotate together with the large bevel gear 135. Thus, the hammer bit 119 performs a striking movement in the axial direction and a rotary movement in the circumferential direction, so that the hammer drill operation is performed on the workpiece.

The above-described operation is performed in the state in which the hammer bit 119 is pressed against the workpiece and in which the hammer bit 119 and the tool holder 137 are pushed rearward. The impact bolt 145 is pushed rearward when the tool holder 137 is pushed rearward. The impact bolt 145 then contacts the front metal washer 155 of the positioning member 151 and the rear metal washer 157 contacts the tool holder 137 via the retaining ring 158. The tool holder 137 is mounted to the gear housing 107 such that it is locked against relative movement in the axial direction. Therefore, the gear housing 107 receives the force of pushing in the hammer bit 119, via the tool holder 137, so that the body 103 is positioned with respect to the workpiece. In this state, a hammering operation or a hammer drill operation is performed. This state is shown in FIGS. 1 and 2. At this time, as described above, the front end surface of the cylinder 141 which forms the weight of the impact damper 161 is held in contact with the rear surface of the front metal washer 155 of the positioning member 151.

After striking movement of the hammer bit 119 upon the workpiece, the hammer bit 119 is caused to rebound by the reaction force from the workpiece. This rebound causes the impact bolt 145 to be acted upon by a rearward reaction force. At this time, the cylinder 141 is in contact with the impact bolt 145 via the front metal washer 155 of the positioning member 151. Therefore, in this state of contact via the front metal washer 155, the reaction force of the impact bolt 145 is transmitted to the cylinder 141. In other words, momentum is exchanged between the impact bolt 145 and the cylinder 141. By such transmission of the reaction force, the impact bolt 145 is held substantially at rest in the striking position, while the cylinder 141 is caused to move rearward in the direction of action of the reaction force. As shown in FIG. 3, the rearward moving cylinder 141 elastically deforms the compression coil spring 165, and the reaction force of the weight 163 is absorbed by such elastic deformation.

At this time, the reaction force of the impact bolt 145 also acts upon the rubber ring 153 which is kept in contact with the impact bolt 145 via the front metal washer 155. Generally, the transmission rate of a force of one object is raised in relation to the Young's modulus of the other object placed in contact with the one object. According to this embodiment, the cylinder 141 is made of hard metal and has high Young's modulus, while the rubber ring 153 made of rubber has low Young's modulus. Therefore, most of the reaction force of the impact bolt 145 is transmitted to the cylinder 141 which has high Young's modulus and which is placed in contact with the metal impact bolt 145 via the hard front metal washer 155. Thus, the impact force caused by rebound of the hammer bit 119 and the impact bolt 145 can be efficiently absorbed by the rearward movement of the cylinder 141 and by the elastic deformation of the coil spring 165 which is caused by the movement of the cylinder 141. As a result, vibration of the hammer drill 101 can be reduced.

Thus, most of the reaction force that the hammer bit 119 and the impact bolt 145 receive from the workpiece after the striking movement can be transmitted from the impact bolt 145 to the cylinder 141. The impact bolt 145 is placed substantially at rest as viewed from the striking position. Therefore, only a small reaction force acts upon the rubber ring 153. Accordingly, only a slight amount of elastic deformation is caused in the rubber ring 153 by such reaction force, and a subsequent repulsion is also reduced. Further, the reaction force of the impact bolt 145 can be absorbed by the impact damper 161 which includes the cylinder 141 and the compression coil spring 165. Therefore, the rubber ring 153 can be made hard. As a result, such rubber ring 153 can provide correct positioning of the body 103 with respect to the workpiece.

In this embodiment, the cylinder 141 which is an existing part forming the main part of the hammer drill 101 is utilized as a weight of the impact damper 161. Therefore, the cushioning weight can be easily secured without increasing the mass of the hammer drill 101. Thus, the hammer drill 101 with the impact damper 161 can be substantially reduced in weight and can be rationalized in its construction.

Further, according to this embodiment, the reaction force from the workpiece is transmitted to the cylinder 141 via the hammer bit 119 and the impact bolt 145. Thus, the reaction force from the workpiece can be transmitted to the cylinder 141 in a concentrated manner without being scattered midway on the transmission path. As a result, the efficiency of transmission of the reaction force to the cylinder 141 increases, so that the impact absorbing function can be enhanced. Further, in this embodiment, the impact bolt 145 contacts the cylinder 141 and the rubber ring 153 via a common hard metal sheet or the front metal washer 155. Therefore, the reaction force of the impact bolt 145 can be transmitted from one point to two members via a common member, that is, from the impact bolt 145 to the cylinder 141 and the rubber ring 153 via the front metal washer 155. Further, the structure can be simplified.

SECOND EMBODIMENT

Figure 4:
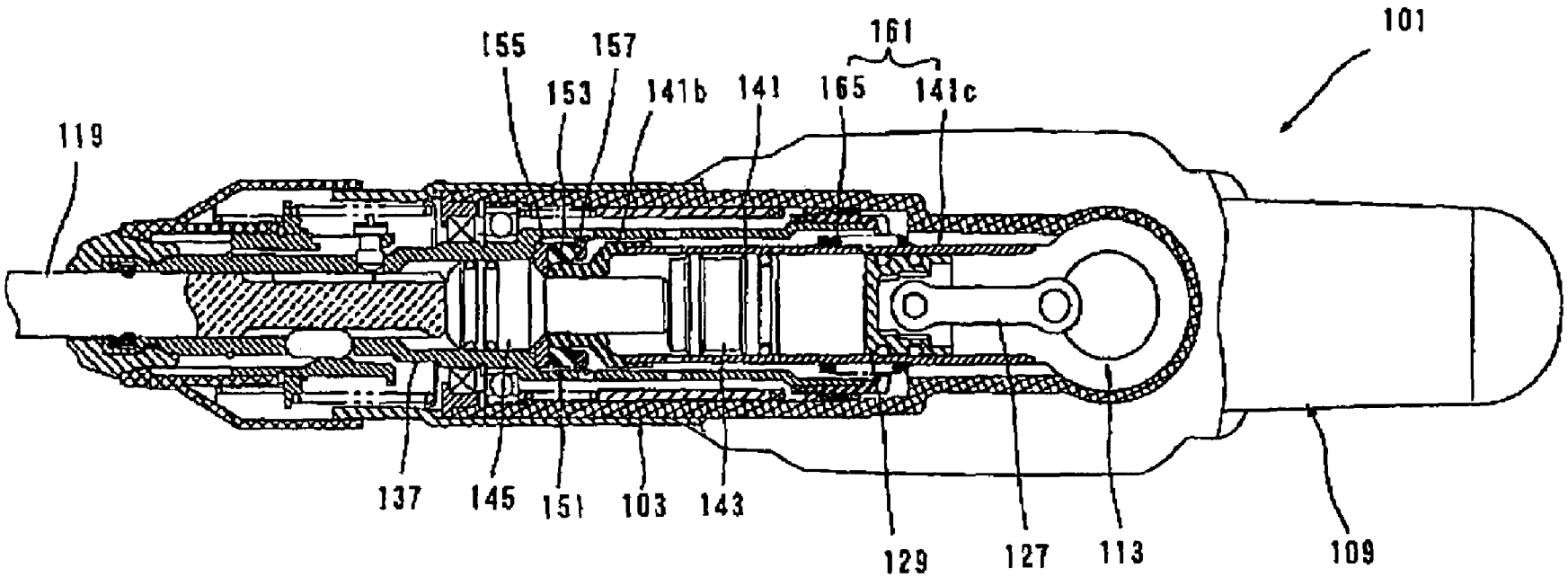
FIG. 4 is a sectional plan view showing an electric hammer drill according to a second embodiment of the invention under loaded conditions in which the hammer bit is pressed against a workpiece.
Figure 5:
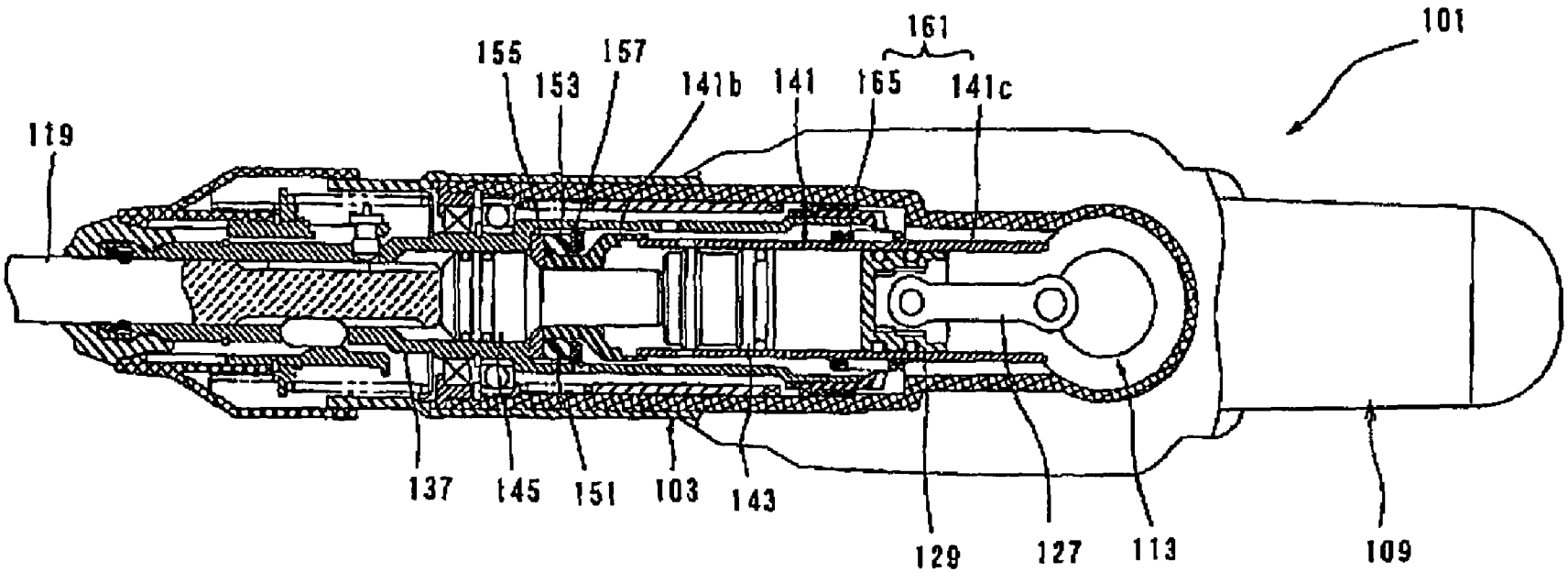
FIG. 5 is a sectional plan view showing the hammer drill during operation of an impact damper.
Figure 6:
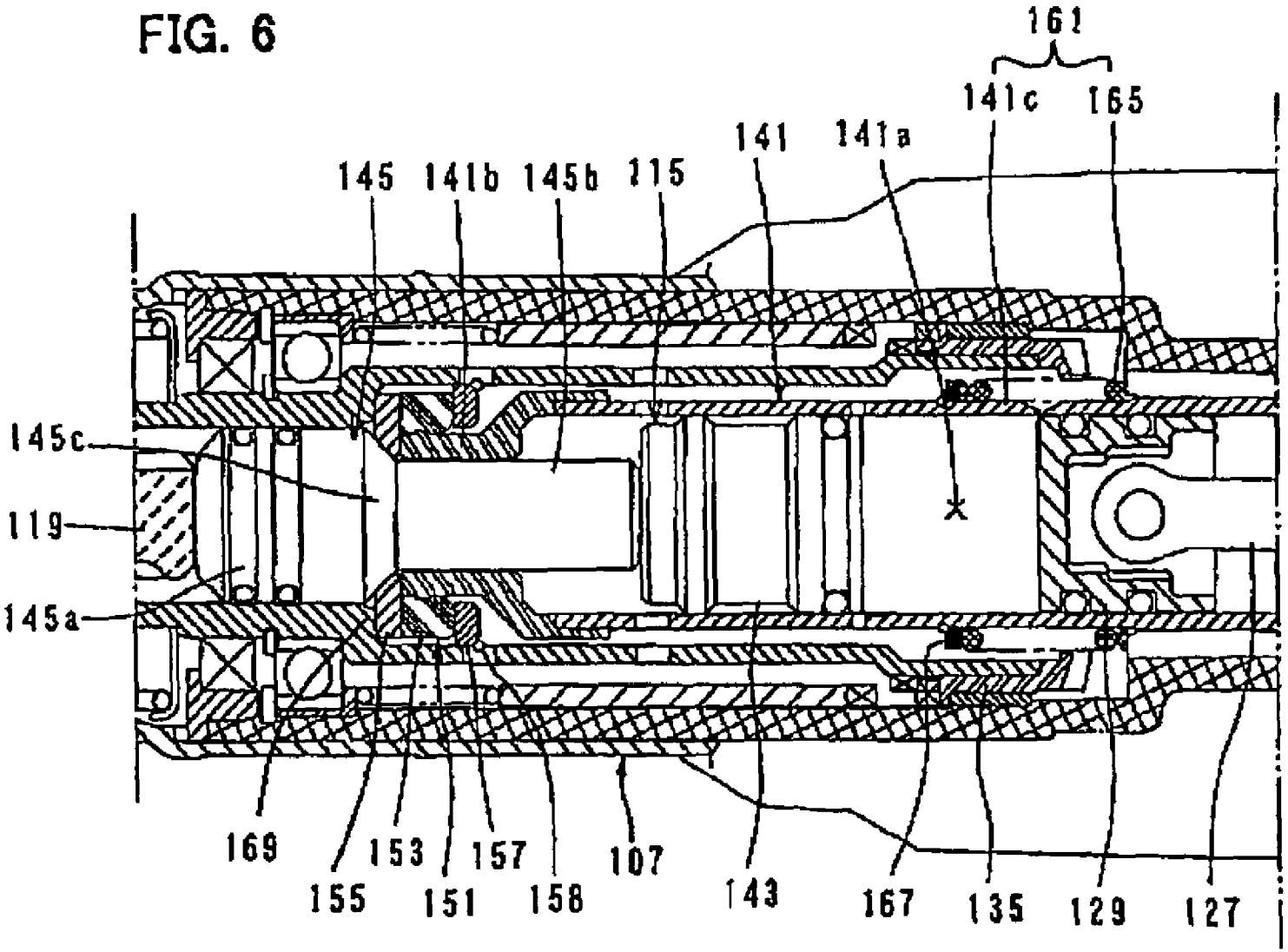
FIG. 6 is a partially enlarged view of FIG. 4.

Now, a second embodiment of the present invention will be described with reference to FIGS. 4 to 6. FIG. 4 shows the hammer drill under loaded conditions in which the hammer bit 119 is pressed against the workpiece. FIG. 5 shows the hammer drill during operation of the impact damper. FIG. 6 is a partially enlarged view of FIG. 4. In this embodiment, the cylinder 141 forming the weight of the impact damper 161 is separated into two parts, i.e. a cylinder body 141*c* for housing the piston 129 and the striker 143 and the front small-diameter cylindrical portion 141*b* which contacts the front metal washer 155 of the positioning member 151. In the other points, it has the same construction as the first embodiment. Components or elements in the second embodiment which are substantially identical to those in the first embodiment are given like numerals as in the first embodiment and will not be described or only briefly described.

The front end portion of the cylinder body 141*c* is loosely fitted into the rear end portion of the front small-diameter cylindrical portion 141*b*. The cylinder body 141*c* can move in the axial direction with respect to the front small-diameter cylindrical portion 141*b* and the axial front end surface of the cylinder body 141*c* can come in surface contact with the rear end surface of the front small-diameter cylindrical portion 141*b*. The cylinder body 141*c* is biased forward by the compression coil spring 165 and contacts the radially inward portion of the rear surface of the front metal washer 155 of the positioning member 151 via the front small-diameter cylindrical portion 141*b*. Under loaded conditions in which the impact bolt 145 is pushed rearward together with the hammer bit 119, the front metal washer 155 is held in surface contact with the tapered surface of the impact bolt 145. Thus, when the hammer bit 119 is caused to rebound by receiving the reaction force from the workpiece after the striking movement of the hammer bit 119, the reaction force of the impact bolt 145 is transmitted to the cylinder body 141*c* that is in contact with the impact bolt 145. The cylinder body 141 is a feature that corresponds to the "weight" and the "rear cylinder element", and the front metal washer 155 and the front small-diameter cylindrical portion 141*b* are features that correspond to the "intervening member" and the "front cylinder element", respectively, according to this invention.

Under loaded conditions in which the hammer bit 119 is pressed against the workpiece, when the hammer bit 119 and the impact bolt 145 are pushed rearward, as shown in FIGS. 4 and 6, the tapered portion 145*c* of the impact bolt 145 contacts the front metal washer 155 of the positioning member 151, and the rear metal washer 157 contacts the tool holder 137 via the retaining ring 158. Thus, the force of pushing in the hammer bit 119 is received by the gear housing 107 of the body 103 via the tool holder 137.

In this state, the hammer bit 119 and the impact bolt 145 are caused to rebound by the reaction force from the workpiece after the striking movement of the hammer bit 119. The reaction force of the impact bolt 145 is transmitted to the cylinder body 141*c* which is placed in contact with the impact bolt 145 via the front metal washer 155 and the front small-diameter cylindrical portion 141*b*. Thus, as shown in FIG. 5, the cylinder body 141*c* is caused to move rearward in the direction of action of the reaction force and elastically deforms the compression coil spring 165. As a result, the impact force caused by rebound of the hammer bit 119 is efficiently absorbed by the rearward movement of the cylinder body 141*c* and the resulting elastic deformation of the compression coil spring 165. Thus, vibration of the hammer drill 101 can be reduced.

According to this embodiment, with a two-part structure of the cylinder 141, the cylinder 141 can be more easily manufactured and an ease of mounting the striker 143 to the cylinder body 141*c* can be enhanced. Further, according to this embodiment, the front small-diameter cylindrical portion 141*b* and the cylinder body 141*c* can be easily assembled together by fitting together.

THIRD EMBODIMENT

Figure 7:
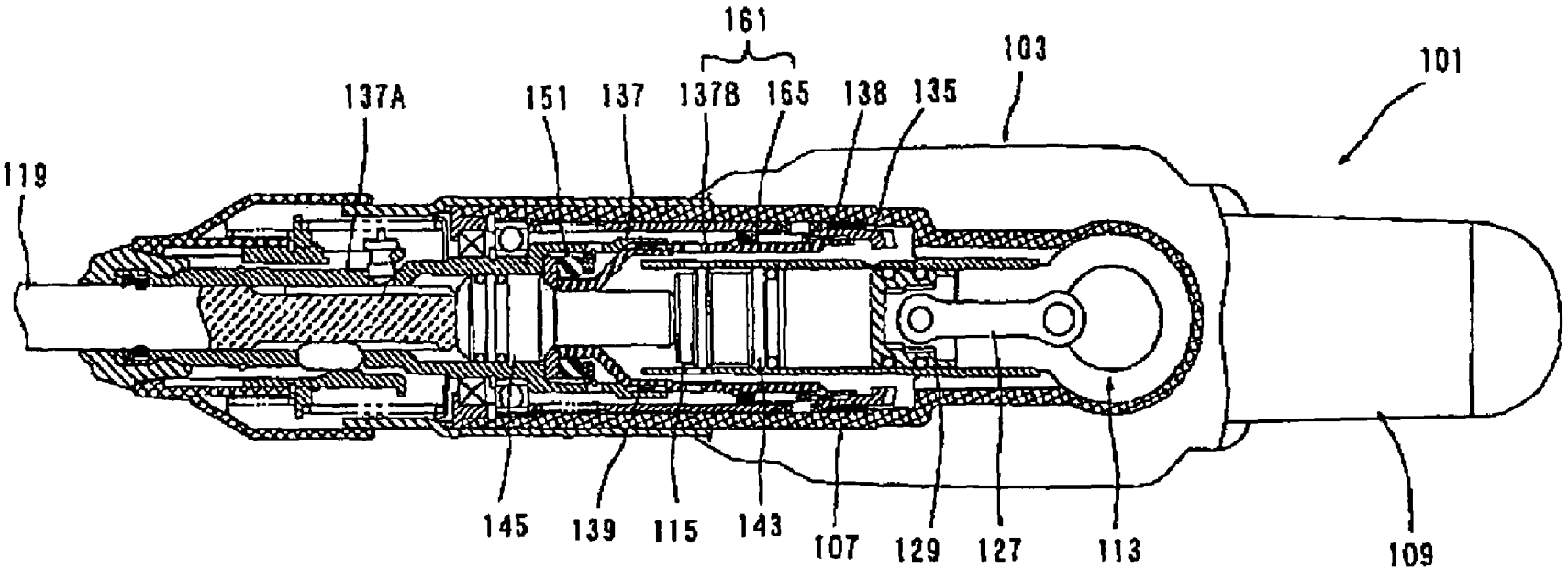
FIG. 7 is a sectional plan view showing an electric hammer drill according to a third embodiment of the invention under loaded conditions in which the hammer bit is pressed against a workpiece.
Figure 8:
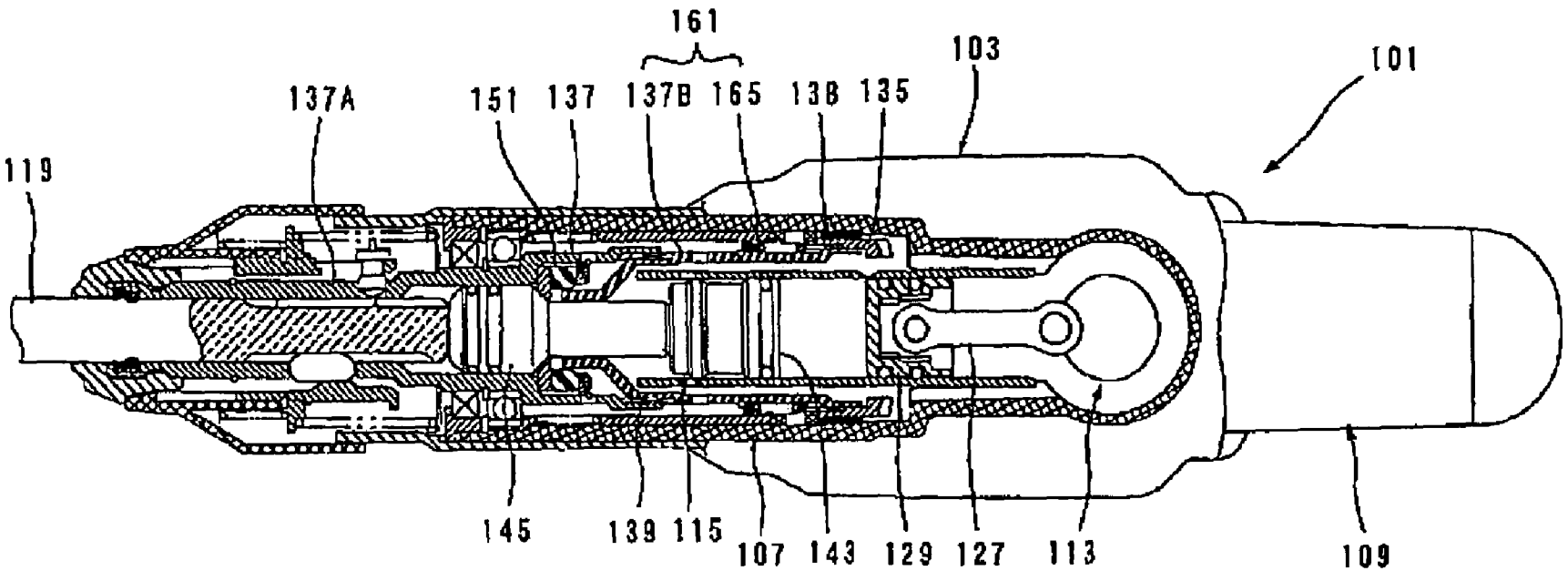
FIG. 8 is a sectional plan view showing the hammer drill during operation of the impact damper.
Figure 9:
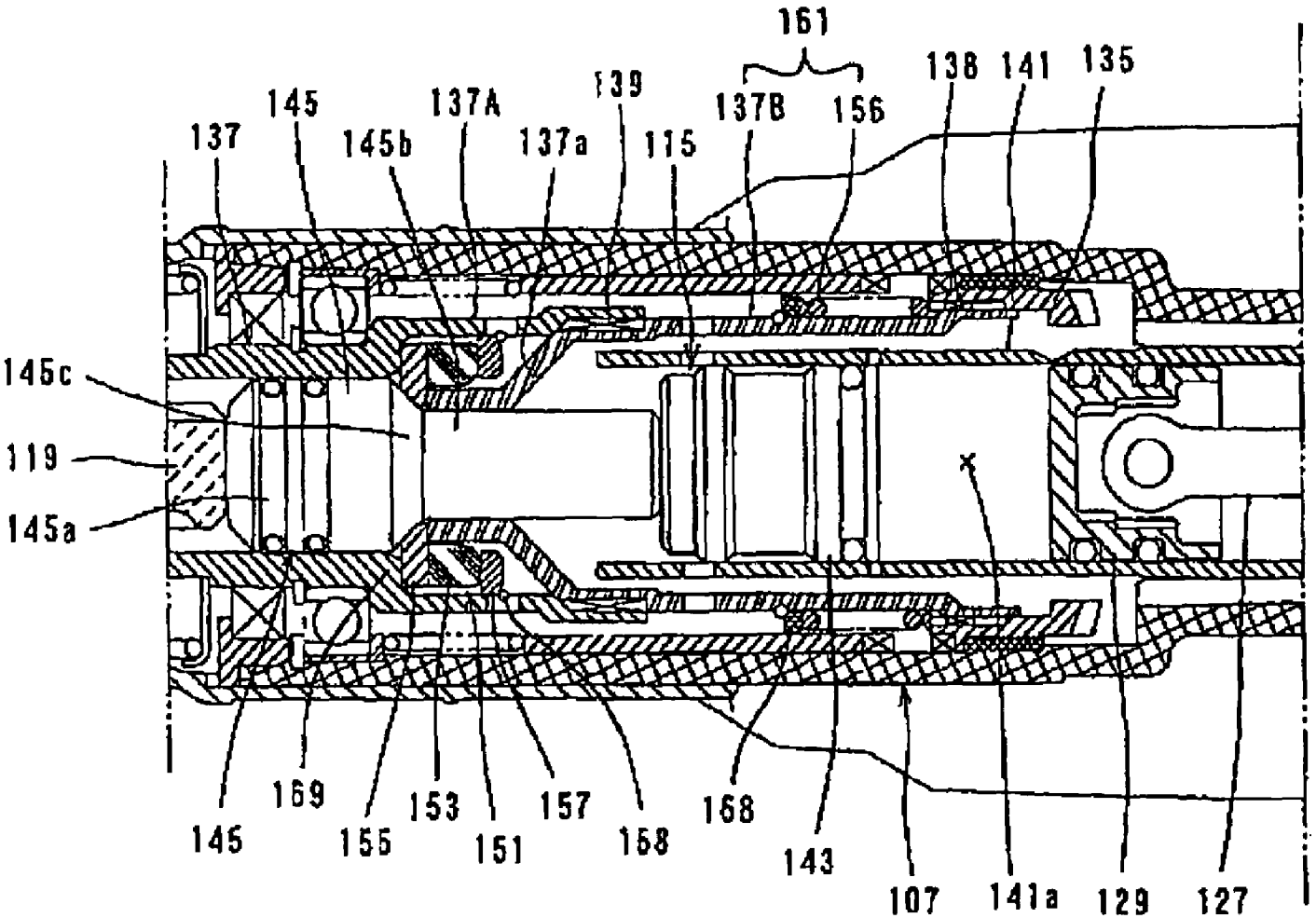
FIG. 9 is a partially enlarged view of FIG. 7.

Third embodiment of the present invention will be described with reference to FIGS. 7 to 9. FIG. 7 shows the hammer drill under loaded conditions in which the hammer bit 119 is pressed against the workpiece. FIG. 8 shows the hammer drill during operation of the impact damper. FIG. 9 is a partially enlarged view of FIG. 7. In this embodiment, the impact damper 161 is comprised of existing parts of the hammer drill 101, i.e. the hard metal tool holder 137 and the compression coil spring 165 that biases the tool holder 137 toward the impact bolt 145 (forward). In the other points, it has the same construction as the first embodiment. Components or elements in the third embodiment which are substantially identical to those in the first embodiment are given like numerals as in the first embodiment and will not be described or only briefly described. Further, in this embodiment, the cylinder 141 does not have the front small-diameter cylindrical portion 141*b* (see FIG. 2) and is fixedly mounted to the gear housing 107.

In this embodiment, the tool holder 137 has a two-part structure separated into a front bit holding part 137A for holding the hammer bit 119 and a rear extension 137B forming a power transmitting part. The front bit holding part 137A and the rear extension 137B are features that correspond to the "front tool holder element" and the "rear tool holder element", respectively, according to the invention. The front bit holding part 137A is rotatably mounted to the gear housing 107 such that it is locked against relative movement in the axial direction. The extension 137B is disposed on the outside of the cylinder 141. The axial rear end portion of the extension 137B is connected to the large bevel gear 135 via a spline joint 138, and the axial middle portion of the extension 137B is connected to the bit holding part 137A via a spline joint 139. Thus, the extension 137B is disposed such that it is allowed to move a predetermined distance in the axial direction and can transmit rotation of the large bevel gear 135 to the bit holding part 137A.

Further, the extension 137B has a small-diameter cylindrical portion 137*a* extending forward from the front spline joint 139. The small-diameter cylindrical portion 137*a* extends forward through the clearance between the inner surfaces of the rubber ring 153 and rear-side metal washer 157 of the positioning member 151 and the outer surface of the small-diameter portion 145*b* of the impact bolt 145. The front end surface of the front small-diameter cylindrical portion 141*b* comes in surface contact with the radially inward portion of the rear surface of the front metal washer 155. The compression coil spring 165 is disposed on the extension 137B. One axial end of the compression coil spring 165 is held in contact with a spring receiving ring 168 fixed to the extension 137B and the other axial end is in contact with the axial front end surface of the large bevel gear 135. Specifically, the compression coil spring 165 is elastically disposed between the extension 137B and the large bevel gear 135 under a predetermined initial load, so that the extension 137B is normally biased forward. The forward position of the extension 137B biased forward by the compression coil spring 165 is defined by contact of the front metal washer 155 with the stepped position-control stopper 169 formed in the tool holder 137. The extension 137B, the compression coil spring 165 and the front metal washer 155 are features that correspond to the "weight", the "elastic element" and the "intervening member", respectively.

As shown in FIGS. 7 and 9, under loaded conditions in which the impact bolt 145 is pushed rearward together with the hammer bit 119, the extension 137B is in contact with the impact bolt 145 via the front metal washer 155. Therefore, when the hammer bit 119 and the impact bolt 145 are caused to rebound by receiving a reaction force from the workpiece after striking movement, the reaction force from the impact bolt 145 is transmitted to the extension 137B which is held in contact with the impact bolt 145 via the front metal washer 155. Thus, the front metal washer 155 forms a reaction force transmitting member. When the extension 137B is moved rearward by receiving a reaction force from the impact bolt 145, the compression coil spring 165 is pushed by the extension 137B. As a result, the compression coil spring 165 elastically deforms and absorbs the reaction force.

According to this embodiment, under loaded conditions in which the hammer bit 119 is pressed against the workpiece, when the hammer bit 119 and the impact bolt 145 are pushed rearward, as shown in FIGS. 7 and 9, the tapered portion 145*c* of the impact bolt 145 contacts the front metal washer 155 of the positioning member 151, and the rear metal washer 157 contacts the bit holding part 137A of the tool holder 137 via the retaining ring 158. Thus, the force of pushing in the hammer bit 119 is received by the gear housing 107 of the body 103 via the bit holding part 137A.

In this state, when a hammer drill operation is performed by the hammer bit 119, the hammer bit 119 and the impact bolt 145 are caused to rebound by the reaction force from the workpiece after the striking movement of the hammer bit 119. The reaction force of the impact bolt 145 is transmitted to the extension 137B of the tool holder 137 which is placed in contact with the impact bolt 145 via the front metal washer 155. Thus, as shown in FIG. 8, the extension 137B is caused to move rearward in the direction of action of the reaction force and elastically deforms the compression coil spring 165. As a result, the impact force caused by rebound of the hammer bit 119 is efficiently absorbed by the rearward movement of the extension 137B and the resulting elastic deformation of the compression coil spring 165. Thus, vibration of the hammer drill 101 can be reduced.

With respect to the above-described first to third embodiments, the present invention can also be applied to a hammer which performs a hammering operation on a workpiece by applying only a striking force to the hammer bit 119 in the axial direction. Further, as the weight of the impact damper 161, the cylinder 141 is utilized in the first and second embodiments, while the tool holder 137 is utilized in the third embodiment. However, it may be configured such that both the cylinder 141 and the tool holder 137 are utilized as the weight of the impact damper 161.

Further, a counter weight may be used in place of the dynamic vibration reducer 171. Further, in the above-described first to third embodiments, a crank mechanism is adopted. However, in the case of the construction using the tool holder 137 as the weight of the impact damper 161, for example, a motion converting mechanism which converts rotation of the rotating element into swinging motion of a swinging member and then converts the swinging motion into linear motion of the piston may be used in place of the crank mechanism.

REFERENCE EXAMPLE

A reference example of an impact power tool is now described with reference to FIGS. 10 to 12. A compression coil spring 193 includes a weight part 193*a* and a spring part 193*b* which form the impact damper 161. The weight part 193*a* and the spring part 193*b* are constructed of one component element by increasing the number of turns of an end turn part of the compression coil spring 193. The end turn part represents an apparently flat portion (generally perpendicular to the axial direction) on either end of the compression coil spring 193 which does not function as a spring. Specifically, in this embodiment, a contact turn region which does not function as a spring is formed by increasing the number of turns of one of the end turn parts of the compression coil spring 193. The contact turn region has a predetermined length in the axial direction and forms the weight part 193*a* of the impact damper 161. The compression coil spring 193 is disposed in an annular space formed between the outer surface of the cylinder 141 and the inner surface of the tool holder 137.

The positioning member 151 is configured such that when the impact bolt 145 is pushed rearward together with the hammer bit 119, the tapered portion 145*c* of the impact bolt 145 contacts the front metal washer 155 of the positioning member 151 while the rear metal washer 157 contacts the axial front end of the cylinder 141. Thus, the rubber ring 153 of the positioning member 151 elastically connects the impact bolt 145 to the cylinder 141 fixedly mounted to the gear housing 107. The front metal washer 155 has a tapered bore, and when the impact bolt 145 is pushed rearward, the tapered surface of the front metal washer 155 comes in surface contact with the tapered portion 145*c* of the impact bolt 145. Further, the rear metal washer 157 has a generally hat-like sectional shape, having a cylindrical portion of a predetermined length which is fitted onto the small-diameter portion 145*b* of the impact bolt 145 and a flange that extends radially outward from the cylindrical portion. The rear surface of the flange is in surface contact with the axial front end of the cylinder 141 via a spacer 159.

The compression coil spring 193 is disposed in the annular space formed between the cylinder 141 and the tool holder 137 in such an orientation that the weight part 193*a* is on the front side and the spring part 193*b* is on the rear side. The rear end of the spring part 193*b* is in contact with a spring receiving ring 195 mounted on the tool holder 137. The spring part 193*b* is put under a predetermined initial load, so that the weight part 193*a* is biased forward. Further, the front end of the weight part 193*a* is normally held in contact with a stepped position-control stopper 197 formed in the tool holder 137, so that the weight part 193*a* is prevented from moving forward beyond the striking position. The striking position is a position in which the striker 143 collides with (strikes) the impact bolt 145, and this position coincides with a position in which the reaction force is transmitted from the impact bolt 145 to the weight part 193*a*.

Under loaded conditions in which the impact bolt 145 is pushed rearward together with the hammer bit 119, the axial front end of the weight part 193*a* of the compression coil spring 193 is held in surface contact with the radially outward portion of the rear surface of the front metal washer 155 of the positioning member 151. Specifically, the weight part 193*a* is placed in contact with the impact bolt 145 via the front metal washer 155. Thus, when the hammer bit 119 and the impact bolt 145 are caused to rebound by receiving the reaction force from the workpiece after the string movement of the hammer bit 119, the reaction force of the impact bolt 145 is transmitted to the weight part 193*a* that is held in contact with the impact bolt 145 via the front metal washer 155. The front metal washer 155 forms a reaction force transmitting member and has a larger outside diameter than the rubber ring 153. Thus, the axial front end of the weight part 193*a* is in contact with an outer region of the front metal washer 155 outward of the outer surface of the rubber ring 153. In this embodiment, the hammer drill 101 has the same construction as the first embodiment except for the above-described construction of the impact damper 161 and the positioning member 151. Components or elements which are substantially identical to those in the first embodiment are given like numerals as in the first embodiment and will not be described.

Figure 10:
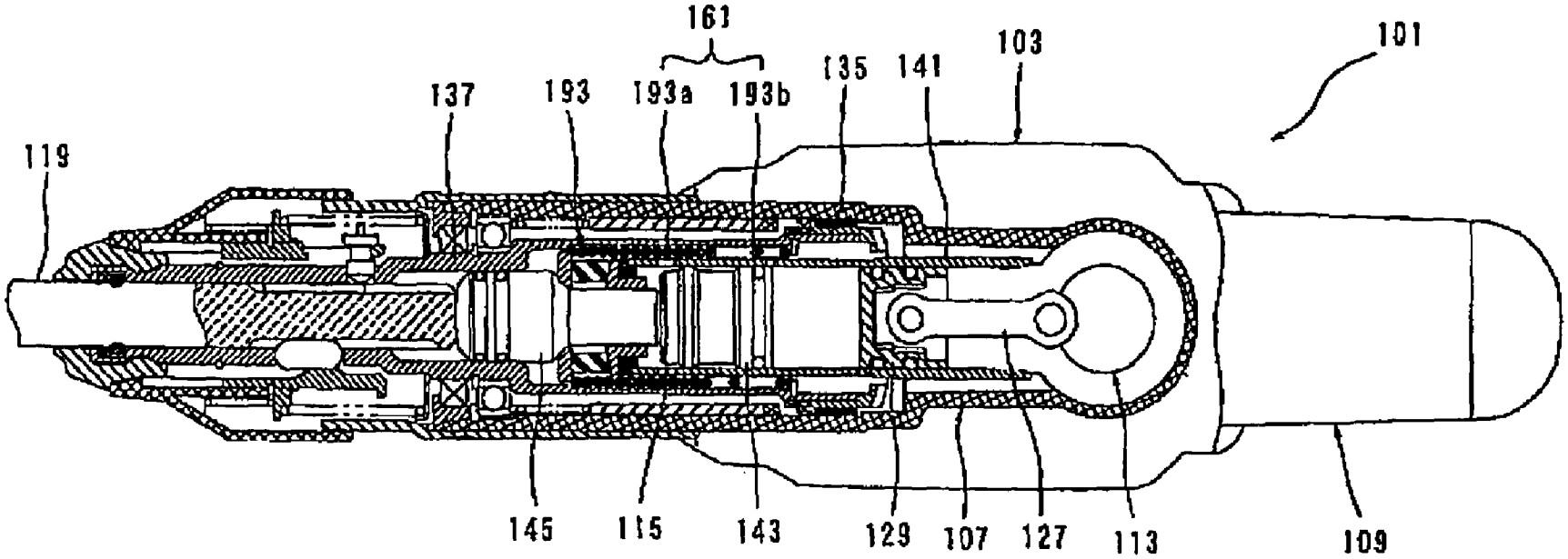
FIG. 10 is a sectional plan view showing an electric hammer drill according to an embodiment as a reference example of the invention under loaded conditions in which the hammer bit is pressed against a workpiece.
Figure 11:
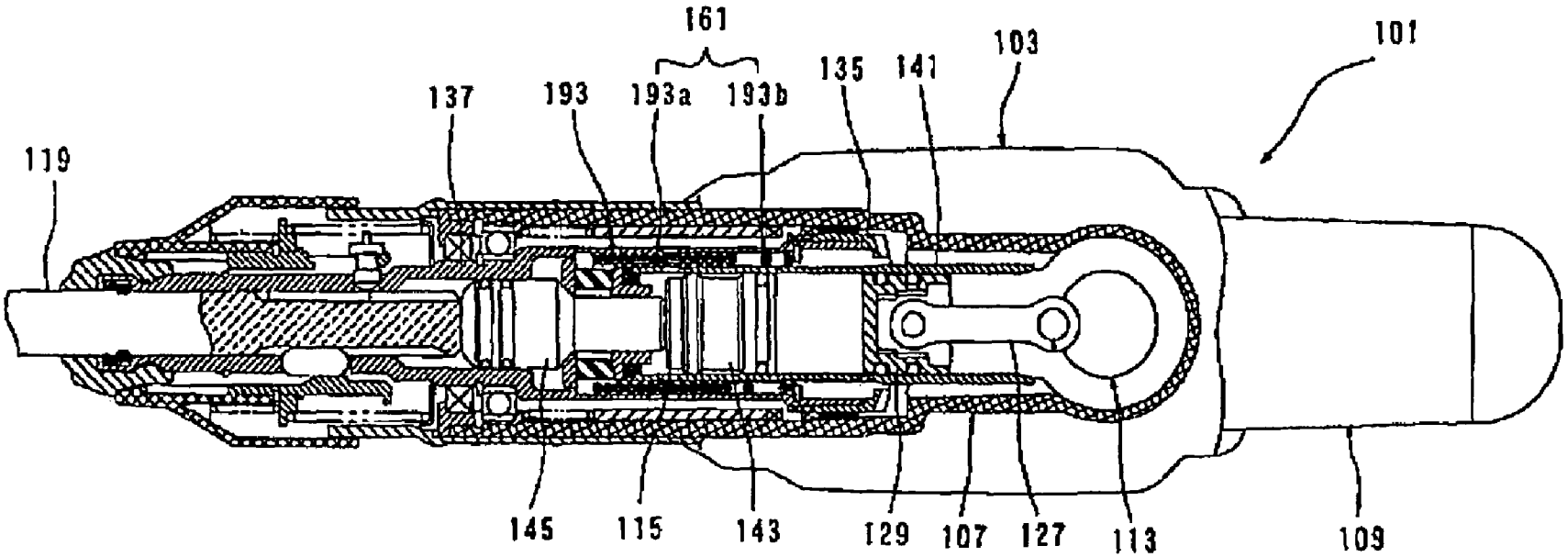
FIG. 11 is a sectional plan view showing the hammer drill during operation of the impact damper.
Figure 12:
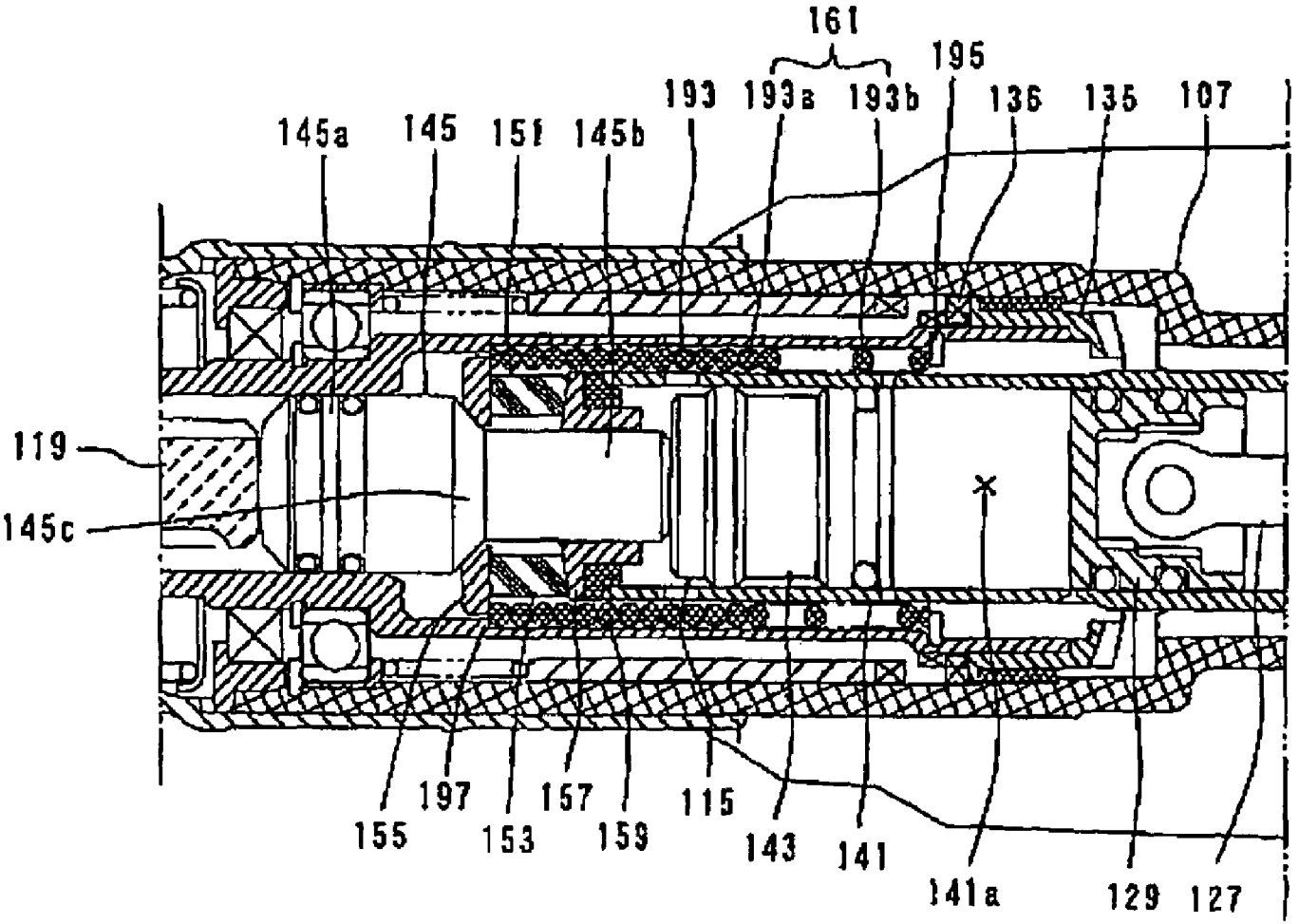
FIG. 12 is a partially enlarged view of FIG. 7.

Under loaded conditions in which the hammer bit 119 is pressed against the workpiece in order to perform a hammer drill operation, when the impact bolt 145 is pushed rearward, as shown in FIGS. 10 and 12, the tapered portion 145*c* of the impact bolt 145 contacts the front metal washer 155 of the positioning member 151 and the rear metal washer 157 contacts the axial front end of the cylinder 141 via the spacer 159. Therefore, the force of pushing in the hammer bit 119 is received by the cylinder 141 fixedly mounted to the gear housing 107. Thus, the body 103 is positioned with respect to the workpiece. In this state, the hammer drill operation is performed. At this time, the front end surface of the weight part 193*a* of the compression coil spring 193 contacts the rear surface of the front metal washer 155 of the positioning member 151.

In this state, when a hammer drill operation is performed by the hammer bit 119, the hammer bit 119 and the impact bolt 145 are caused to rebound by the reaction force from the workpiece after the striking movement of the hammer bit 119. The reaction force of the impact bolt 145 is transmitted to the weight part 193*a* of the compression coil spring 193 which is held in contact with the impact bolt 145 via the front metal washer 155. Thus, as shown in FIG. 11, the weight part 193*a* is caused to move rearward in the direction of action of the reaction force and elastically deforms the spring part 193*b*. As a result, the impact force caused by rebound of the hammer bit 119 is absorbed by the movement of the weight part 193*a* and the elastic deformation of the spring part 193*b*. Thus, vibration of the hammer drill 101 can be reduced.

Because the weight part 193*a* of the impact damper 161 is formed by increasing the number of turns of the end turn part of the compression coil spring 193, even in the construction in which the impact damper 161 is additionally provided, the number of component parts can be minimized and the structure can be simplified. Further, the mass of the weight part 193*a* can be readily adjusted by changing the number of turns of the end turn part of the compression coil spring 193. Further, the compression coil spring 193 of this embodiment may comprise a square spring having a square section.

DESCRIPTION OF NUMERALS

101 hammer drill
103 body (tool body)
105 motor housing
107 gear housing
109 handgrip
109*a* pivot
109*b* elastic spring
111 driving motor
113 motion converting mechanism
115 striking mechanism
117 power transmitting mechanism
119 hammer bit
121 driving gear
123 driven gear
125 crank plate
126 eccentric shaft
127 crank arm
128 connecting shaft
129 piston
131 transmission gear
133 transmission shaft

134 small bevel gear
135 large bevel gear
136 engagement clutch
137 tool holder
137A bit holding part
137B extension
137*a* small-diameter cylindrical portion
141 cylinder
141*a* air chamber
141*b* front small-diameter cylindrical portion
141*c* cylinder body
143 striker
145 impact bolt (hammer actuating member)
145*a* large-diameter portion
145*b* small-diameter portion
145*c* tapered portion
151 positioning member
153 rubber ring
155 front metal washer
157 rear metal washer
158 retaining ring
159 spacer
161 impact damper
165 compression coil spring
167 spring receiving ring
169 stopper
171 dynamic vibration reducer
172 cylindrical body
173 weight
174 biasing spring
175 first actuation chamber
175*a* first communicating portion
176 second actuation chamber
176*a* second communicating portion
177 crank chamber
178 cylinder accommodating space
193 compression coil spring
193*a* weight part
193*b* spring part
195 spring receiving ring
197 stopper

What is claimed is:

1. An impact power tool comprising:

a tool body, a hammer actuating member that is disposed in a tip end region of the tool body and performs a predetermined hammering operation on a workpiece by reciprocating movement in its axial direction, a tool holder that at least partially holds the hammer actuating member, wherein the tool holder is mounted to a gear housing such that the tool holder is prevented from relative movement in the axial direction with respect to the gear housing, a driving mechanism that is disposed on a rear side of the tool body opposite the hammer actuating member and linearly drives the hammer actuating member, a cylinder that houses the driving mechanism, the cylinder being mounted to the gear housing such that the cylinder is slidable in an axial direction of the cylinder relative to a crankshaft mechanism that drives the driving mechanism, and an elastic element, wherein a weight defined by at least one of (i) the slidable cylinder, (ii) a slidable rear extension of the tool holder and (iii) a slidable weight part of the elastic element, is placed in contact with the hammer actuating member to move rearward in the tool body when a reaction force is transmitted thereto from the hammer actuating member during a hammering operation on the workpiece, and the elastic element elastically deforms when the weight moves rearward in the tool body and pushes against the elastic element such that the elastic element absorbs the reaction force transmitted to the weight.

2. The impact power tool as defined in claim 1, wherein the weight is placed in contact with the hammer actuating member via an intervening member made of metal and moves rearward in the tool body by receiving the reaction force from the hammer actuating member via the intervening member.

3. The impact power tool as defined in claim 1, wherein the cylinder further includes:

a rear cylinder element that comprises a rear portion of the cylinder and defines the weight; and a front cylinder element that comprises a front portion of the cylinder, wherein the rear cylinder element is separated from the front cylinder element and is placed in contact with the hammer actuating member via the front cylinder element or via a metal intervening member and the front cylinder element in series, and the rear cylinder element moves rearward in the tool body when the reaction force is transmitted from the hammer actuating member via the front cylinder element or via the metal intervening member and the front cylinder element.

4. The impact power tool as defined in claim 1, wherein the weight comprises the rear extension that defines a rear portion of the tool holder and a front bit holding part of the tool holder comprises a front portion of the tool holder, the rear extension is separated from the front bit holding part and is placed in contact with the hammer actuating member, and the rear extension moves rearward in the tool body when the reaction force is transmitted thereto from the hammer actuating member.

5. The impact power tool as defined in claim 1, wherein the hammer actuating member further comprises:

an impact bolt that is linearly driven in the axial direction by the driving mechanism; and a tool bit that reciprocates by receiving a striking force from the impact bolt and thereby performs a hammering operation on the workpiece, wherein, during hammering operation on the workpiece, the impact bolt transmits the reaction force from the workpiece to the weight by contact with the weight.

6. The impact power tool as defined in claim 1, wherein the hammer actuating member further comprises:

an impact bolt linearly driven in the axial direction by the driving mechanism; and a tool bit linearly moved by receiving a striking force from the impact bolt to perform a hammering operation on the workpiece, wherein the tool holder rotates about the axis of the hammer actuating member to cause the tool bit to rotate such that the tool bit performs a hammer drill operation by linear striking movement via the driving mechanism and the impact bolt and by rotation via the tool holder.

7. The impact power tool as defined in claim 1, wherein the elastic element is provided under a predetermined initial load to normally bias the cylinder, the rear extension or the slidable weight part forward.

8. The impact power tool as defined in claim 1 further comprising:

a dynamic vibration reducer having a vibration reducing weight and at least one biasing spring that biases the vibration reducing weight, wherein the vibration reducing weight is positively driven by pressure fluctuations caused in relation to the movement of the driving mechanism within the cylinder.

* * * * *